US010825444B2

(12) United States Patent
Gu et al.

(10) Patent No.: US 10,825,444 B2
(45) Date of Patent: Nov. 3, 2020

(54) SPEECH SYNTHESIS METHOD AND APPARATUS, COMPUTER DEVICE AND READABLE MEDIUM

(71) Applicant: BAIDU ONLINE NETWORK TECHNOLOGY (BEIJING) CO., LTD., Beijing (CN)

(72) Inventors: Yu Gu, Beijing (CN); Xiaohui Sun, Beijing (CN)

(73) Assignee: BAIDU ONLINE NETWORK TECHNOLOGY (BEIJING) CO., LTD., Beijing (CN)

( * ) Notice: Subject to any disclaimer, the term of this patent is extended or adjusted under 35 U.S.C. 154(b) by 110 days.

(21) Appl. No.: 16/213,473

(22) Filed: Dec. 7, 2018

(65) Prior Publication Data

US 2019/0371292 A1 Dec. 5, 2019

(30) Foreign Application Priority Data

Jun. 4, 2018 (CN) ..... 2018 1 0565148

(51) Int. Cl.
*G10L 13/08* (2013.01)
*G10L 13/047* (2013.01)

(52) U.S. Cl.
CPC ..... *G10L 13/08* (2013.01); *G10L 13/047* (2013.01)

(58) Field of Classification Search
USPC ..... 704/220, 257–260
See application file for complete search history.

(56) References Cited

U.S. PATENT DOCUMENTS

2013/0262120 A1* 10/2013 Hirose ..... G10L 13/02 704/260
2016/0365085 A1* 12/2016 Raghavendra ..... G10L 25/03
2018/0190265 A1* 7/2018 Raghavendra ..... G10L 13/00

FOREIGN PATENT DOCUMENTS

CN 102385858 A 3/2012
CN 103377651 A 4/2014
(Continued)

OTHER PUBLICATIONS

First Office Action and Search Report from CN app. No. 201810565148.8, dated Mar. 4, 2019, with machine English translation from Google Translate.
(Continued)

*Primary Examiner* — Leonard Saint Cyr
(74) *Attorney, Agent, or Firm* — Ladas & Parry, LLP

(57) ABSTRACT

The present disclosure provides a speech synthesis method and apparatus, a computer device and a readable medium. The method comprises: when problematic speech appears in speech splicing and synthesis, predicting a time length of a state of each phoneme corresponding to a target text corresponding to the problematic speech and a base frequency of each frame, according to pre-trained time length predicting model and base frequency predicting model; according to the time length of the state of each phoneme corresponding to the target text and the base frequency of each frame, using a pre-trained speech synthesis model to synthesize speech corresponding to the target text; wherein the time length predicting model, the base frequency predicting model and the speech synthesis model are all obtained by training based on a speech library resulting from speech splicing and synthesis. The technical solution of the present disclosure may avoid complementarily recording language materials and re-building a library, effectively shorten the time for repair of the problematic speech, and save the repair costs of
(Continued)

the problematic problem; it may be ensured that naturalness and continuity of the synthesized speech is improved, and the sound quality of the speech synthesized by the model, as compared with the sound quality of the speech resulting from the splicing and synthesis, does not change and does not affect the user's listening feeling.

6 Claims, 4 Drawing Sheets

(56) References Cited

FOREIGN PATENT DOCUMENTS

| | | | |
|---|---|---|---|
| CN | 104934028 | A | 9/2015 |
| CN | 107705783 | A | 2/2018 |
| JP | S54139308 | A | 10/1979 |
| JP | 2001350491 | A | 12/2001 |
| JP | 2007141993 | A | 6/2007 |

OTHER PUBLICATIONS

Notice of Reasons for Refusal from JP app. No. 2018-244454, dated Feb. 13, 2020, with English translation provided by Global Dossier.

* cited by examiner

SPEECH SYNTHESIS METHOD AND APPARATUS, COMPUTER DEVICE AND READABLE MEDIUM

The present application claims the priority of Chinese Patent Application No. 201810565148.8, filed on Jun. 4, 2018, with the title of "Speech synthesis method and apparatus, computer device and readable medium", The disclosure of the above applications is incorporated herein by reference in its entirety.

FIELD OF THE DISCLOSURE

The present disclosure relates to the technical field of computer application, and particularly to a speech synthesis method and apparatus, a computer device and a readable medium.

BACKGROUND OF THE DISCLOSURE

Speech syntheses technologies are mainly classified into two large class: technology based on statistics parameters and splicing and synthesis technology based on unit selection. The two large classes of speech synthesis methods have their own advantages, but also have respective problems.

For example, the speech synthesis technology based on statistic parameters currently only requires a small-scale speech library, it is adapted for speech synthesis tasks in an offline scenario, and meanwhile also may be applied to tasks such as expressive synthesis, emotional speech synthesis and speaker conversion. The speech synthesized by this class of method is relatively stable and exhibits better continuity. However, due to influence from effects such as limited modelling capability of the acoustic model and statistic smoothing, sound quality of speech synthesized from statistic parameters is relatively poor. Different from parameter synthesis, splicing synthesis needs a large-scale speech library, and is mainly applied to speech synthesis tasks of an online device. Since the splicing synthesis relates to electing waveform segments in the speech library and splicing by a special algorithm, the sound quality of the synthesized speech is better and closer to natural speech. However, due to use of the splicing manner, undesirable continuity exists between many different speech units. In the case of a given synthesized text, if selection of candidate units of the speech library is not precise enough or specific vocabulary or phrases cannot be covered by language materials of the speech library, the speech resulting from splicing synthesis shows problems such as undesirable naturalness and continuity and will seriously affect the user's listening feeling. To solve the technical problem, it is possible in the prior art to employ a manner of complementarily recording the speech library, then re-complement some corresponding language materials in the speech library, and re-build a library to repair corresponding problems.

However, in the prior art, it is a relatively long and iterative process from receiving problems fed back from products to re-inviting the speaker to perform complementary recording of language materials to re-building a library. A repair cycle of the problematic speech is longer and cannot achieve an effect of instant repair.

SUMMARY OF THE DISCLOSURE

The present disclosure provides a speech synthesis method and apparatus, a computer device and a readable medium, to quickly repair the problematic speech having undesirable naturalness and continuity in the splicing and synthesis.

The present disclosure provides a speech synthesis method, the method comprising:

when problematic speech appears in speech splicing and synthesis, predicting a time length of a state of each phoneme corresponding to a target text corresponding to the problematic speech and a base frequency of each frame, according to pre-trained time length predicting model and base frequency predicting model;

according to the time length of the state of each phoneme corresponding to the target text and the base frequency of each frame, using a pre-trained speech synthesis model to synthesize speech corresponding to the target text; wherein the time length predicting model, the base frequency predicting model and the speech synthesis model are all obtained by training based on a speech library resulting from speech splicing and synthesis.

Further optionally, in the above-mentioned method, before predicting a time length of a state of each phoneme corresponding to a target text and a base frequency of each frame, according to pre-trained time length predicting model and base frequency predicting model, the method further comprises:

training the time length predicting model, the base frequency predicting model and the speech synthesis model, according to the text and corresponding speech in the speech library.

Further optionally, in the above-mentioned method, the training the time length predicting model, the base frequency predicting model and the speech synthesis model, according to the text and corresponding speech in the speech library specifically comprises:

extracting several training texts and corresponding training speeches from the text and corresponding speech in the speech library;

respectively extracting the time length of the state corresponding to each phoneme in each training speech and the base frequency corresponding to each frame, from the several training speeches:

training the time length predicting model according to respective training texts and the time length of the state corresponding to each phoneme in corresponding training speeches;

training the base frequency predicting model according to respective training texts and the base frequency corresponding to each frame in corresponding training speeches;

training the speech synthesis model according to respective training texts, corresponding respective training speeches, the time length of the state corresponding to each phoneme in corresponding respective training speeches and the base frequency corresponding to each frame.

Further optionally, in the above-mentioned method, before predicting a time length of a state of each phoneme corresponding to a target text and a base frequency of each frame, according to pre-trained time length predicting model and base frequency predicting model, the method further comprises:

upon using the speech library to perform speech splicing and synthesis, receiving the problematic speech fed back by a user and the target text corresponding to the problematic speech.

Further optionally, in the above-mentioned method, after the step of, according to the time length of the state of each phoneme corresponding to the target text and the base frequency of each frame, using a pre-trained speech synthesis model to synthesize speech corresponding to the target text, the method further comprises:

adding the target text and the corresponding synthesized speech into the speech library.

Further optionally, in the above-mentioned method, the speech synthesis model employs a WaveNet model.

The present disclosure provides a speech synthesis apparatus, the apparatus comprising:

a prediction module configured to, when problematic speech appears in speech splicing and synthesis, predict a time length of a state of each phoneme corresponding to a target text corresponding to the problematic speech and a base frequency of each frame, according to pre trained time length predicting model and base frequency predicting model:

a synchronization module configured to, according to the time length of the state of each phoneme corresponding to the target text and the base frequency of each frame, use a pre-trained speech synthesis model to synthesize speech corresponding to the target text; wherein the time length predicting model, the base frequency predicting model and the speech synthesis model are all obtained by training based on a speech library resulting from speech splicing and synthesis.

Further optionally, the above-mentioned apparatus further comprises:

a training module configured to train the time length predicting model, the base frequency predicting model and the speech synthesis model, according to the text and corresponding speech in the speech library.

Further optionally, the above-mentioned apparatus, the training module is specifically configured to:

extract several training texts and corresponding training speeches from the text and corresponding speech in the speech library;

respectively extract the time length of the state corresponding to each phoneme in each training speech and the base frequency corresponding to each frame, from the several training speeches;

train the time length predicting model according to respective training texts and the time length of the state corresponding to each phoneme in corresponding training speeches;

train the base frequency predicting model according to respective training texts and the base frequency corresponding to each frame in corresponding training speeches;

train the speech synthesis model according to respective training texts, corresponding respective training speeches, the time length of the state corresponding to each phoneme in corresponding respective training speeches and the base frequency corresponding to each frame.

Further optionally, the above-mentioned apparatus further comprises:

a receiving module configured to, upon using the speech library to perform speech splicing and synthesis, receive the problematic speech fed back by a user and the target text corresponding to the problematic speech.

Further optionally, the above-mentioned apparatus further comprises:

an adding module configured to add the target text and the corresponding synthesized speech into the speech library.

Further optionally, in the above-mentioned apparatus, the speech synthesis model employs a WaveNet model.

The present disclosure further provides a computer device, the device comprising:

one or more processors, a memory for storing one or more programs, the one or more programs, when executed by said one or more processors, enable said one or more processors to implement the above-mentioned speech synthesis method.

The present disclosure further provides a computer readable medium on which a computer program is stored, the program, when executed by a processor, implementing the above-mentioned speech synthesis method.

According to a speech synthesis method and apparatus, a computer device and a readable medium of the present disclosure, it is possible to, when problematic speech appears in speech splicing and synthesis, predict a time length of a state of each phoneme corresponding to a target text and a base frequency of each frame, according to pre-trained time length predicting model and base frequency predicting model; according to the time length of the state of each phoneme corresponding to the target text and the base frequency of each frame, use a pre-trained speech synthesis model to synthesize speech corresponding to the target text; wherein the time length predicting model, the base frequency predicting model and the speech synthesis model are all obtained by training based on a speech library resulting from speech splicing and synthesis. The technical solution of the present embodiment may achieve, in the above manner, the repair of the problematic speech when the problematic speech occurs in the speech splicing and synthesis, avoid complementarily recording language materials and re-building a library, effectively shorten the time for repair of the problematic speech, save the repair costs of the problematic problem, and improve the repair efficiency of the problematic speech. Furthermore, in the technical solution of the present embodiment, since the time length predicting model, the base frequency predicting model and the speech synthesis model are obtained by training based on a speech library resulting from speech splicing and synthesis, naturalness and continuity of the speech synthesized by the model may be ensured, and the sound quality of the speech synthesized by the model, as compared with the sound quality of the speech resulting from the splicing and synthesis, does not change and does not affect the user's listening feeling.

DETAILED DESCRIPTION OF PREFERRED EMBODIMENTS

Figure 1:
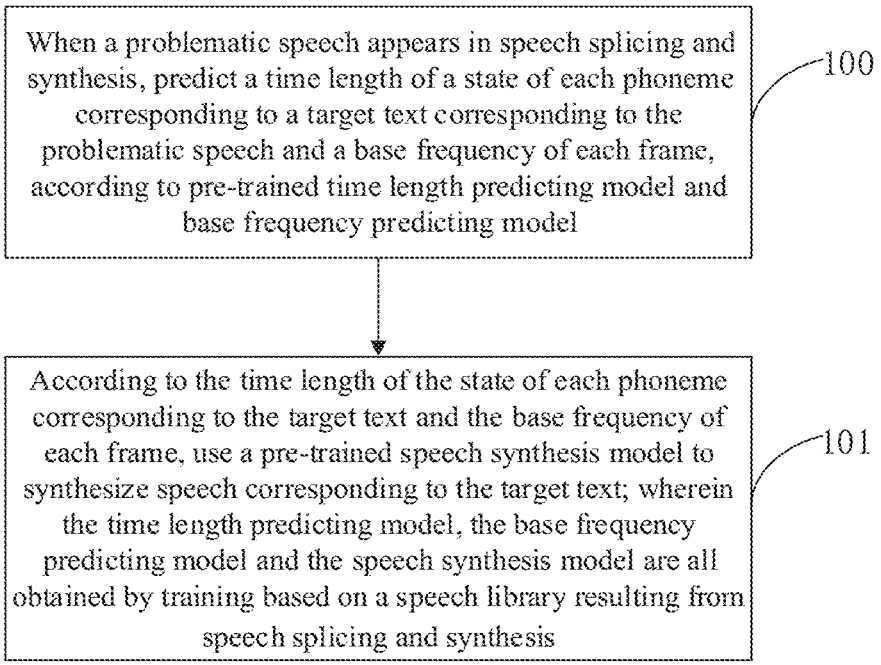
FIG. 1 is a flow chart of a first embodiment of a speech synthesis method according to the present disclosure.

The present disclosure will be described in detail with reference to figures and specific embodiments to make objectives, technical solutions and advantages of the present disclosure more apparent, FIG. 1 is a flow chart of a first embodiment of a speech synthesis method according to the present disclosure. As shown in FIG. 1, the speech synthesis method according to the present embodiment may specifically include the following steps:

100: when problematic speech appears in speech splicing and synthesis, predicting a time length of a state of each phoneme corresponding to a target text corresponding to the problematic speech and a base frequency of each frame, according to pre-trained time length predicting model and base frequency predicting model;

101 according to the time length of the state of each phoneme corresponding to a target text and the base frequency of each frame, using a pre-trained speech synthesis model to synthesize speech corresponding to the target text; wherein the time length predicting model, the base frequency predicting model and the speech synthesis model are all obtained by training based on a speech library resulting from speech splicing and synthesis.

A subject for executing the speech synthesis method of the present embodiment is a speech synthesis apparatus. Specifically, during speech splicing and synthesis, if the text to be synthesized cannot be completely covered by language materials of the speech library, problems such as undesirable naturalness and continuity appear in the spliced and synthesized speech. In the prior art, it is necessary to complementarily record language materials and re-build a library to repair the problem, so that the repair cycle of the problematic speech is longer. To address this problem, in the present embodiment, the speech synthesis apparatus is employed to implement speech synthesis for this portion of text to be synthesized, as a complementary scheme when the problematic speech occurs during the current speech splicing and synthesis, and implements speech synthesis from another perspective to effectively shorten the repair cycle of the problematic speech.

Specifically, in the speech synthesis method of the present embodiment, it is necessary to pre-train the time length predicting model and base frequency predicting model. The time length predicting model is used to predict the time length of the state of each phoneme in the target text. Phoneme is a minimal unit in speech. For example, in pronunciation of the Chinese language, an initial consonant or a simple or compound vowel may be a phoneme. In pronunciation of other languages, each pronunciation also corresponds to a phoneme. In the present embodiment, each phoneme may be segmented into five states according to a hidden Markov model, and the time length of the state is a duration in this state. The pre-trained time length predicting model in the present embodiment may predict time lengths of all states of each phoneme in the target text. In addition, in the present embodiment, it is further necessary to train the base frequency predicting model which may predict the base frequency of each frame in the pronunciation of the target text.

The time length of the state of each phoneme corresponding to a target text and the base frequency of each frame in the present embodiment are necessary features of speech synthesis. Specifically, it is possible to input the time length of the state of each phoneme corresponding to a target text and the base frequency of each frame into the pre-trained speech synthesis model, and the speech synthesis model may synthesize and output the speech corresponding to the target text. As such, when problems such as undesirable naturalness and continuity appear upon splicing and synthesis, the solution of the present embodiment may be directly used for speech synthesis. Since the time length predicting model, the base frequency predicting model and the speech synthesis model are all obtained by training based on a speech library resulting from speech splicing and synthesis in the speech synthesis solution of the present embodiment, it is possible to ensure that the sound quality of the synthesized speech is the same as the sound quality in the speech library resulting from speech splicing and synthesis, i.e., make the synthesized speech and the spliced pronunciation sound like the same articulator's speech, thereby ensuring the user's listening feeling and enhance the user's experience in use. Furthermore, the time length predicting model, the base frequency predicting model and the speech synthesis model are all pre-obtained in the speech synthesis solution of the present embodiment, so an instant repair effect may be achieved upon repairing the problematic speech.

According to the speech synthesis method of the present embodiment, it is possible to predict a time length of a state of each phoneme corresponding to a target text and a base frequency of each frame, according to pre-trained time length predicting model and base frequency predicting model; according to the time length of the state of each phoneme corresponding to the target text and the base frequency of each frame, use a pre-trained speech synthesis model to synthesize speech corresponding to the target text; wherein the time length predicting model, the base frequency predicting model and the speech synthesis model are all obtained by training based on a speech library resulting from speech splicing and synthesis. The technical solution of the present embodiment may achieve, in the above manner, the repair of the problematic speech when the problematic speech occurs in the speech splicing and synthesis, avoid complementarily recording language materials and re-building a library, effectively shorten the time for repair of the problematic speech, save the repair costs of the problematic problem, and improve the repair efficiency of the problematic speech. Furthermore, in the technical solution of the present embodiment, since the time length predicting model, the base frequency predicting model and the speech synthesis model are obtained by training based on a speech library resulting from speech splicing and synthesis, naturalness and continuity of the speech synthesized by the model may be ensured, and the sound quality of the speech synthesized by the model, as compared with the sound quality of the speech resulting from the splicing and synthesis, does not change and does not affect the user's listening feeling.

Figure 2:
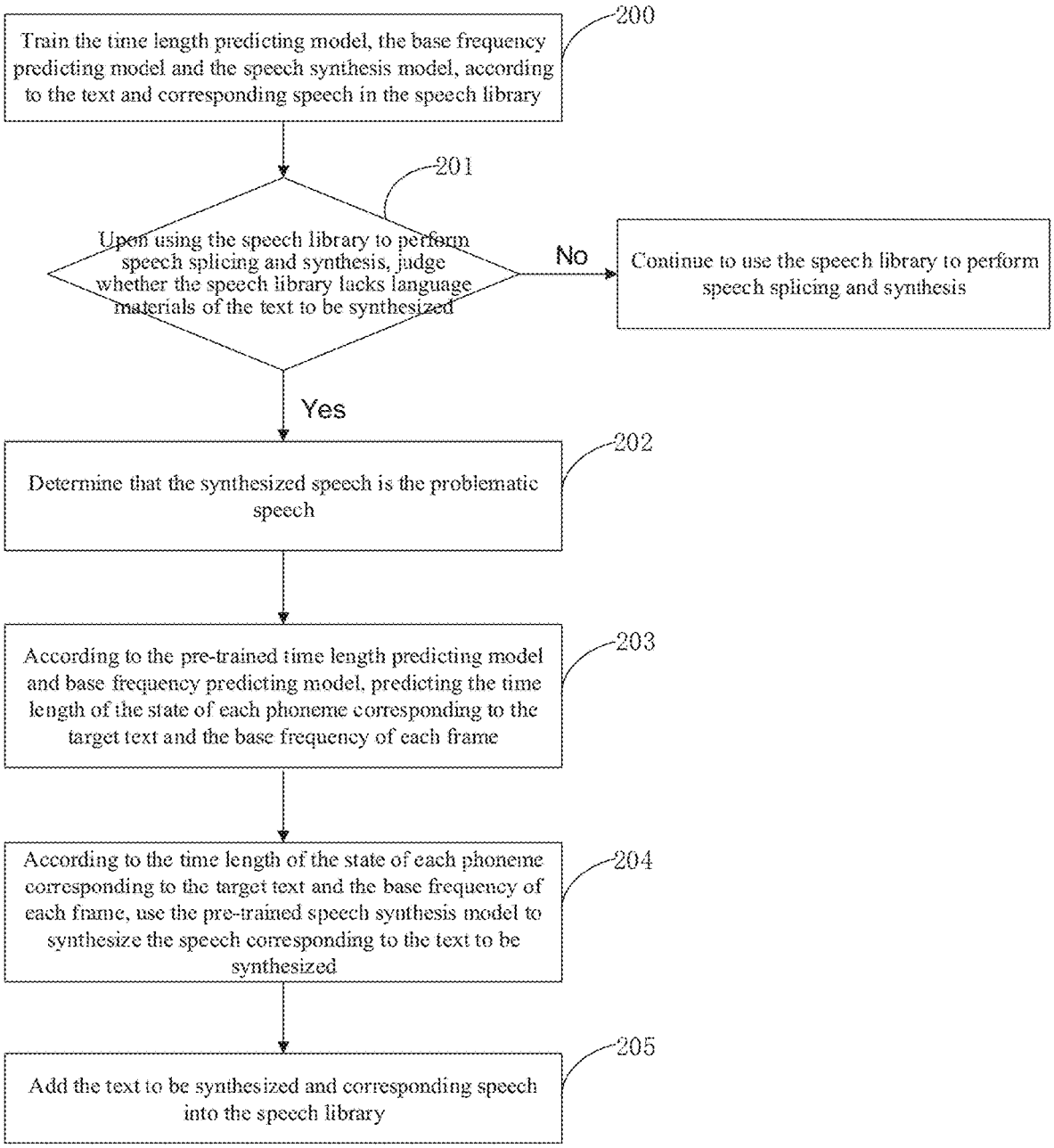
FIG. 2 is a flow chart of a second embodiment of a speech synthesis method according to the present disclosure.

FIG. 2 is a flow chart of a second embodiment of a speech synthesis method according to the present disclosure. As shown in FIG. 2, the speech synthesis method according to the present embodiment, on the basis of the technical solution of the embodiment shown in FIG. 1, further introduce the technical solution of the present disclosure in more detail. As shown in FIG. 2, the speech synthesis method according to the present embodiment may specifically comprise the following steps:

200: training the time length predicting model, the base frequency predicting model and the speech synthesis model, according to the text and corresponding speech in the speech library;

Specifically, step 200 may specifically include the following steps:

(a) extracting several training texts and corresponding training speeches from the text and corresponding speech in the speech library;

(b) respectively extracting the time length of the state corresponding to each phoneme in each training speech and the base frequency corresponding to each frame, from the several training speeches;

(c) training the time length predicting model according to respective training texts and the time length of the state corresponding to each phoneme in corresponding training speeches;

(d) training the base frequency predicting model according to respective training texts and the base frequency corresponding to each frame in corresponding training speeches;

(e) training the speech synthesis model according to respective training texts, corresponding respective training speeches, the time length of the state corresponding to each phoneme in corresponding respective training speeches and the base frequency corresponding to each frame.

The speech library used in speech splicing and synthesis in the present embodiment may include sufficient original language materials which may include original texts and corresponding original speeches, for example, may include original speech of 20 hours, First, it is feasible to extract several training texts and corresponding training speeches from the speech library, for example, each training text may be a sentence. Then it is possible to respectively extract, from several training speeches, extract the time length of the state corresponding to each phoneme in respective training speeches according to the hidden Markov model, and meanwhile extract the base frequency corresponding to each frame in each training speech in the several training speeches. Then, it is possible to respectively train three models. The specific number of several training texts and corresponding training speeches in the present embodiment may be set according to actual demands, for example, may be more than ten thousand training texts and corresponding training speeches.

For example, the time length predicting model is trained according to respective training texts and the time length of the state corresponding to each phoneme in corresponding training speeches. Before training, it is possible to set an initial parameter for the time length predicting model, and then input the training text, the time length predicting model predicting the time length of the state corresponding, to each phoneme in the training speech corresponding to the training text; then compare the predicted time length of the state corresponding to each phoneme in the training speech corresponding to the training text with a real time length of the state corresponding to each phoneme in the corresponding training speech to judge whether a differential value of the two is within a preset range, and if no, adjust the parameter of the time length predicting model so that the differential value of the two falls within the present range. Multiple training texts and time length of the state corresponding to each phoneme in corresponding training speeches may be employed to constantly train the time length predicting model, determine parameters of the time length predicting model, and thereby determine the time length predicting model. The training of the time length predicting model is completed.

In addition, it is specifically possible to train the base frequency predicting model according to respective training texts and the base frequency corresponding to each frame in corresponding training speeches. Likewise, before training, it is possible to set an initial parameter for the base frequency predicting model. The base frequency predicting model predicts the base frequency corresponding to each frame in the training speech corresponding to the training text; then it is feasible to compare the base frequency of each frame predicted by the base frequency predicting model with a real base frequency of each frame in the corresponding training speech to judge whether a differential value of the two is within a preset range, and if no, adjust the parameter of the base frequency predicting model so that the differential value of the two falls within the present range. Multiple training texts and base frequency corresponding to each frame in corresponding training speeches may be employed to constantly train the base frequency predicting model, determine the parameter of the base frequency predicting model, and thereby determine the base frequency predicting model. The training of the base frequency predicting model is completed.

Furthermore, it is possible to train the speech synthesis model according to respective training texts, corresponding respective training speeches, the time length of the state corresponding to each phoneme in corresponding respective training speeches and the base frequency corresponding to each frame. The speech synthesis model in the present embodiment may employ a WaveNet model. The WaveNet model is a model advanced by DeepMind group in 2016 and having a waveform modeling function. The WaveNet model has attracted extensive concerns from industrial and academic circles since it was advanced.

In the speech synthesis model such as the WaveNet model, the time length of the state corresponding to each phoneme in the training speech of each training text and the base frequency corresponding to each frame are regarded as necessary features of the synthesized speech. Before training, an initial parameter is set for the WaveNet model. Upon training, it is possible to input respective training texts, the time length of the state corresponding to each phoneme in corresponding respective training speeches and the base frequency corresponding to each frame into the WaveNet model, the WaveNet model outputting a synthesized speech according to input features; then calculate a cross entropy of the synthesized speech and the training speech; then adjust parameters of the WaveNet model by a gradient descent method so that the cross entropy reaches a minimal value, namely, this indicates that the speech synthesized by the WaveNet model is close enough to the corresponding training speech. In the above manner, it is possible to employ multiple training texts, corresponding multiple training speeches, the time length of the state corresponding to each phoneme in corresponding respective training speeches and base frequency corresponding to each frame to constantly train the WaveNet model, determine the parameter of the WaveNet model, and thereby determine the WaveNet model. The training of the WaveNet model is completed.

The above process of training the time length predicting model, the base frequency predicting model and speech synthesis model in the present embodiment may be an offline training process to obtain the above three modules for online use when a problem happens to the speech splicing and synthesis.

201: upon using the speech library to perform speech splicing and synthesis, judging whether the problematic speech fed back by a user and the target text corresponding to the problematic speech are received; if yes, performing step 202; otherwise, continuing to use the speech library to perform speech splicing and synthesis.

202: determining the speech of the target text spliced by the speech splicing technology according to the speech library as the problematic speech: performing step 203;

Upon speech splicing and synthesis, if the speech library lacks the language material of the target text, this causes undesirable continuity and naturalness of the spliced speech, whereupon the synthesized speech is the problematic speech, and usually causes the user's failure to use normally.

203: according to the pre-trained time length predicting model and base frequency predicting model, predicting the time length of the state of each phoneme corresponding to the target text and the base frequency of each frame; executing step 204;

204: according to the time length of the state of each phoneme corresponding to the target text and the base frequency of each frame, using the pre-trained speech synthesis model to synthesize the speech corresponding to the target text; executing step 205;

For step 203 and step 204, reference may be made to step 100 and step 101 in the embodiment shown in FIG. 1, and detailed depictions are not provided any more.

205: adding the target text and corresponding synthesized speech into the speech library to update the speech library.

Through the above processing, it is possible to synthesize speech corresponding to the target text, and then add the speech into the speech library. As such, when the speech library is subsequently used to perform speech splicing and synthesis, naturalness and continuity of speech splicing and synthesis may be improved. Only when the problematic speech occurs is the manner of the present embodiment employed to synthesize speech. Further, the synthesize speech and the original speech in the speech library have the same sound quality so that the user hears them as being articulated by the same articulator and the user's listening feeling is not affected. Furthermore, through the manner of the present embodiment, it is possible to constantly expand the language materials in the speech library, so that the efficiency of subsequently using the speech splicing and synthesis is higher; furthermore, in the technical solution of the present embodiment, updating the speech library can not only upgrade the speech library, but also upgrade the service of the speech splicing and synthesis system using the updated speech library and can satisfy demands of more speech splicing and synthesis.

According to the speech synthesis method of the present embodiment, it is possible to implement the repair of the problematic speech in the above manner when the problematic speech occurs in the speech splicing and synthesis, avoid complementarily recording language materials and re-building a library, effectively shorten the time for repair of the problematic speech, save the repair costs of the problematic problem, and improve the repair efficiency of the problematic speech. Furthermore, in the technical solution of the present embodiment, since the time length predicting model, the base frequency predicting model and the speech synthesis model are obtained by training based on a speech library resulting from speech splicing and synthesis, naturalness and continuity of the speech synthesized by the model may be ensured, and the sound quality of the speech synthesized by the model, as compared with the sound quality of the speech resulting from the splicing and synthesis, does not change and does not affect the user's listening feeling.

Figure 3:
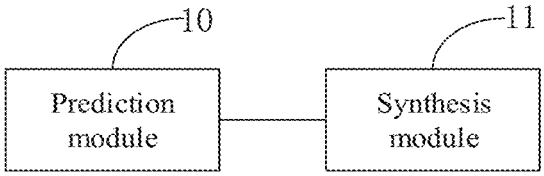
FIG. 3 is a structural diagram of a first embodiment of a speech synthesis apparatus according to the present disclosure.

FIG. 3 is a structural diagram of a first embodiment of a speech synthesis apparatus according to the present disclosure. As shown in FIG. 3, the speech synthesis apparatus according to the present embodiment may specifically comprise:

a prediction module 10 configured to, when problematic speech appears in speech splicing and synthesis, predict a time length of a state of each phoneme corresponding to a target text corresponding to the problematic speech and a base frequency of each frame, according to pre-trained time length predicting model and base frequency predicting model;

a synchronization module 11 configured to, according to the time length of the state of each phoneme corresponding to the target text and the base frequency of each frame predicted by the prediction module 10, use a pre-trained speech synthesis model to synthesize speech corresponding to the target text; wherein the time length predicting model, the base frequency predicting model and the speech synthesis model are all obtained by training based on a speech library resulting from speech splicing and synthesis.

Principles employed by speech synthesis apparatus according to the present embodiment to implement the speech synthesis by using the above modules and the resultant technical effects are the same as those of the above-mentioned method embodiments. For particulars, please refer to the depictions of the aforesaid relevant method embodiments, and no detailed depictions will be presented here.

Figure 4:
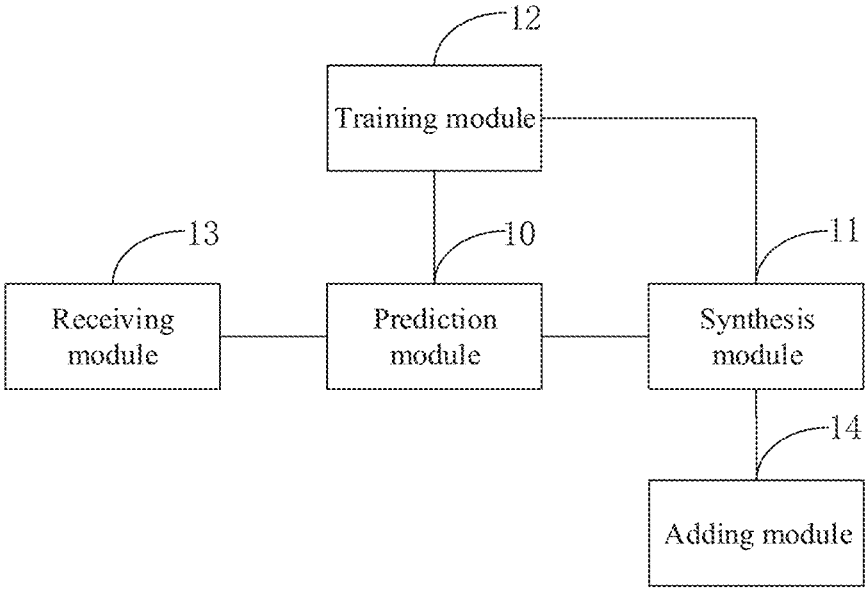
FIG. 4 is a structural diagram of a second embodiment of a speech synthesis apparatus according to the present disclosure.

FIG. 4 is a structural diagram of a second embodiment of a speech synthesis apparatus according to the present disclosure. As shown in FIG. 4, the speech synthesis apparatus according to the present embodiment, on the basis of the technical solution of the embodiment shown in FIG. 3, may specifically comprise:

as shown in FIG. 4, the speech synthesis apparatus of the present embodiment further comprises; a training module 12 configured to train the time length predicting model, the base frequency predicting model and the speech synthesis model, according to the text and corresponding speech in the speech library.

Correspondingly, the prediction module 10 is configured to, according to the time length predicting model and base frequency predicting mode pre-trained by the training module 12, predict the time length of the state of each phoneme corresponding to the target text and the base frequency of each frame;

Correspondingly, the synthesis module 11 is configured to, according to the time length of the state of each phoneme corresponding to the target text and the base frequency of each frame predicted by the prediction module 10, use the speech synthesis model pre-trained by the training module 12 to synthesize the speech corresponding to the target text;

Further optionally, as shown in FIG. 4, in the speech synthesis apparatus of the present embodiment, the training module 12 is specifically configured to:

extract several training texts and corresponding training speeches from the text and corresponding speech in the speech library;

respectively extract the time length of the state corresponding to each phoneme in each training speech and the base frequency corresponding to each frame, from the several training speeches;

train the time length predicting model according to respective training texts and the time length of the state corresponding to each phoneme in corresponding training speeches;

train the base frequency predicting model according to respective training texts and the base frequency corresponding to each frame in corresponding training speeches;

train the speech synthesis model according to respective training texts, corresponding respective training speeches, the time length of the state corresponding to each phoneme in corresponding respective training speeches and the base frequency corresponding to each frame.

Further optionally, as shown in FIG. 4, the speech synthesis apparatus of the present embodiment further comprises:

a receiving module 13 configured to, upon using the speech library to perform speech splicing and synthesis, receive the problematic speech fed back by a user and the target text corresponding to the problematic speech.

Correspondingly, the receiving module 13 may be configured to trigger the predicting module 10. After receiving the problematic speech fed back by a user, the receiving module 13 triggers the predicting module 10 to, according to the pre-trained time length predicting, model and base frequency predicting, model, predict the time length of the state of each phoneme corresponding to the target text and the base frequency of each frame.

Further optionally, as shown in FIG. 4, the speech synthesis apparatus of the present embodiment further comprises:

an adding module 14 configured to add the target text and the corresponding speech synthesized by the synthesis module 11 into the speech library.

Further optionally, in the speech synthesis apparatus of the present embodiment, the speech synthesis model employs a WaveNet model.

Principles employed by speech synthesis apparatus according to the present embodiment to implement the speech synthesis by using the above modules and the resultant technical effects are the same as those of the above-mentioned method embodiments. For particulars, please refer to the depictions of the aforesaid relevant method embodiments, and no detailed depictions will be presented here.

Figure 5:
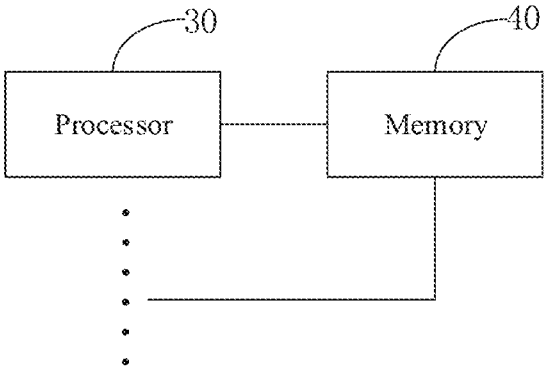
FIG. 5 is a structural diagram of an embodiment of a computer device according to the present disclosure.

FIG. 5 is a block diagram of an embodiment of a computer device according to the present disclosure. As shown in FIG. 5, the computer device according to the present embodiment comprises: one or more processors 30, and a memory 40 for storing one or more programs; the one or more programs stored in the memory 40, when executed by said one or more processors 30, enable said one or more processors 30 to implement the speech synthesis method of the embodiments shown in FIG. 1-FIG. 2. The embodiment shown in FIG. 5 exemplarily includes a plurality of processors 30.

Figure 6:
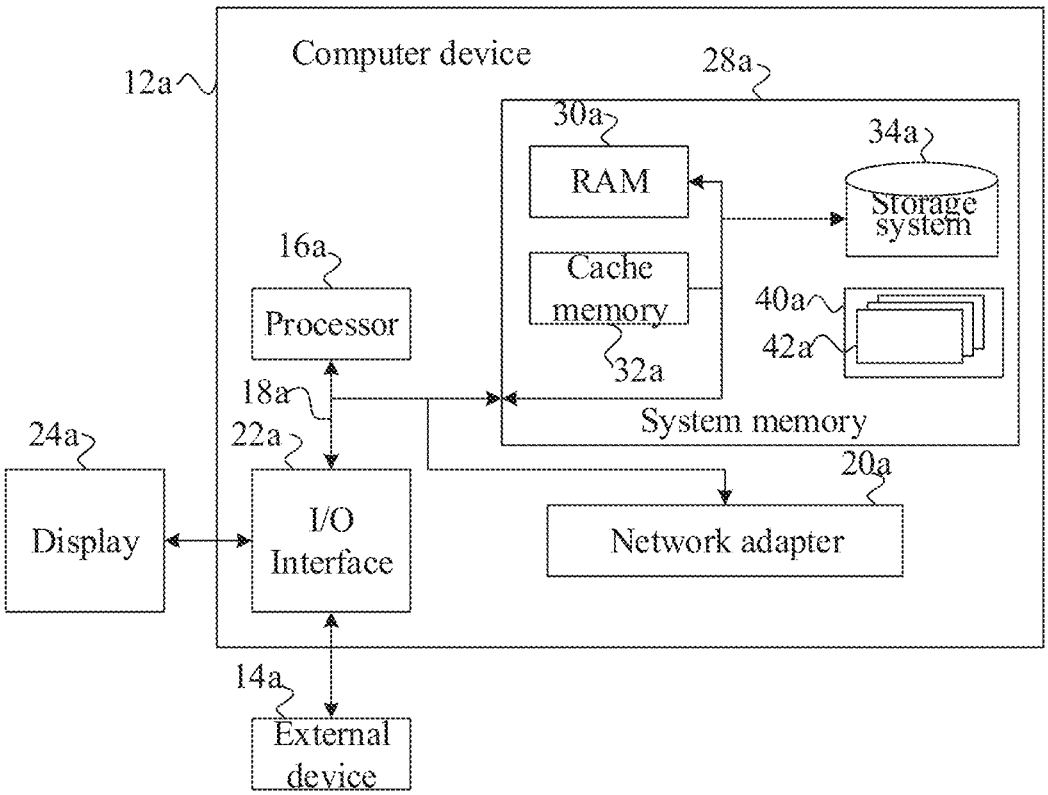
FIG. 6 is an example diagram of a computer device according to the present disclosure.

For example, FIG. 6 is an example diagram of a computer device according to an embodiment of the present disclosure. FIG. 6 shows a block diagram of an example computer device 12*a* adapted to implement an implementation mode of the present disclosure. The computer device 12*a* shown in FIG. 6 is only an example and should not bring about any limitation to the function and scope of use of the embodiments of the present disclosure.

As shown in FIG. 6, the computer device 12*a* is shown in the form of a general-purpose computing device. The components of computer device 12*a* may include, but are not limited to, one or more processors 16*a*, a system memory 28*a*, and a bus 18*a* that couples various system components including the system memory 28*a* and the processors 16*a*.

Bus 18*a* represents one or more of several types of bus structures, including a memory bus or memory controller, a peripheral bus, an accelerated graphics port, and a processor or local bus using any of a variety of bus architectures, By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer device 12*a* typically includes a variety of computer system readable media. Such media may be any available media that is accessible by computer device 12*a*, and it includes both volatile and non-volatile media, removable and non-removable media.

The system memory 28*a* can include computer system readable media in the form of volatile memory, such as random access memory (RAM) 30*a* and/or cache memory 32*a*. Computer device 12*a* may further include other removable/non-removable, volatile/non-volatile computer system storage media. By way of example only, storage system 34*a* can be provided for reading from and writing to a non-removable, non-volatile magnetic media (not shown in FIG. 6 and typically called a "hard drive"). Although not shown in FIG. 6, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each drive can be connected to bus 18*a* by one or more data media interfaces. The system memory 28*a* may include at least one program product having a set (e.g., at least one) of program modules that are configured to carry out the functions of embodiments shown in FIG. 1-FIG. 4 of the present disclosure.

Program/utility 40*a*, having a set (at least one) of program modules 42*a*, may be stored in the system memory 28*a* by way of example, and not limitation, as well as an operating system, one or more disclosure programs, other program modules, and program data. Each of these examples or a certain combination thereof might include an implementation of a networking environment. Program modules 42*a* generally carry out the functions and/or methodologies of embodiments shown in FIG. 1-FIG. 4 of the present disclosure.

Computer device 12*a* may also communicate with one or more external devices 14*a* such as a keyboard, a pointing device, a display 24*a*, etc.; with one or more devices that enable a user to interact with computer device 12*a*; and/or with any devices (e.g., network card, modem, etc.) that enable computer device 12*a* to communicate with one or more other computing devices. Such communication can occur via Input/Output (I/O) interfaces 22*a*. Still yet, computer device 12*a* can communicate with one or more networks such as a local area network (LAN), a general wide area network (WAN), and/or a public network (e.g., the Internet) via network adapter 20*a*. As depicted in FIG. 5, network adapter 20*a* communicates with the other communication modules of computer device 12*a* via bus 18*a*. It should be understood that although not shown, other hardware and/or software modules could be used in conjunction with computer device 12*a*. Examples, include, but are not limited to: microcode, device drivers, redundant processing units, external disk drive arrays, RAID systems, tape drives, and data archival storage systems, etc.

The processor 16*a* executes various function applications and data processing by running programs stored in the system memory 28*a*, for example, implements the speech synthesis method shown in the above embodiments.

The present disclosure further provides a computer readable medium on which a computer program is stored, the program, when executed by a processor, implementing the speech synthesis method shown in the above embodiments.

The computer readable medium of the present embodiment may include RAM 30*a*, and/or cache memory 32*a* and/or a storage system 34*a* in the system memory 28*a* in the embodiment shown in FIG. 6.

As science and technology develops, a propagation channel of the computer program is no longer limited to tangible medium, and it may also be directly downloaded from the network or obtained in other manners. Therefore, the computer readable medium in the present embodiment may include a tangible medium as well as an intangible medium.

The computer-readable medium of the present embodiment may employ any combinations of one or more computer-readable media. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the text herein, the computer readable storage medium can be any tangible medium that include or store programs for use by an instruction execution system, apparatus or device or a combination thereof.

The computer-readable signal medium may be included in a baseband or serve as a data signal propagated by part of a carrier, and it carries a computer-readable program code therein. Such propagated data signal may take many forms, including, but not limited to, electromagnetic signal, optical signal or any suitable combinations thereof. The computer-readable signal medium may further be any computer-readable medium besides the computer-readable storage medium, and the computer-readable medium may send, propagate or transmit a program for use by an instruction execution system, apparatus or device or a combination thereof.

The program codes included by the computer-readable medium may be transmitted with any suitable medium, including, but not limited to radio, electric wire, optical cable, RF or the like, or any suitable combination thereof.

Computer program code for carrying out operations disclosed herein may be written in one or more programming languages or any combination thereof. These programming languages include an object oriented programming language such as Java, Smalltalk, C++ or the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

In the embodiments provided by the present disclosure, it should be understood that the revealed system, apparatus and method can be implemented in other ways. For example, the above-described embodiments for the apparatus are only exemplary, e.g., the division of the units is merely logical one, and, in reality, they can be divided in other ways upon implementation.

The units described as separate parts may be or may not be physically separated, the parts shown as units may be or may not be physical units, i.e., they can be located in one place, or distributed in a plurality of network units. One can select some or all the units to achieve the purpose of the embodiment according to the actual needs.

Further, in the embodiments of the present disclosure, functional units can be integrated in one processing unit, or they can be separate physical presences; or two or more units can be integrated in one unit. The integrated unit described above can be implemented in the form of hardware, or they can be implemented with hardware plus software functional units.

The aforementioned integrated unit in the form of software function units may be stored in a computer readable storage medium. The aforementioned software function units are stored in a storage medium, including several instructions to instruct a computer device (a personal computer, server, or network equipment, etc.) or processor to perform some steps of the method described in the various embodiments of the present disclosure. The aforementioned storage medium includes various media that may store program codes, such as U disk, removable hard disk, Read-Only Memory (ROM), a Random Access Memory (RAM), magnetic disk, or an optical disk.

What are stated above are only preferred embodiments of the present disclosure and not intended to limit the present disclosure. Any modifications, equivalent substitutions and improvements made within the spirit and principle of the present disclosure all should be included in the extent of protection of the present disclosure.

What is claimed is:

1. A speech synthesis method, wherein the method comprises:

training a time length predicting model, a base frequency predicting model and a speech synthesis model, according to a text and corresponding speech in the speech library;

when problematic speech appears in speech splicing and synthesis, predicting a time length of a state of each phoneme corresponding to a target text corresponding to the problematic speech and a base frequency of each frame, according to the pre-trained time length predicting model and the base frequency predicting model;

according to the time length of the state of each phoneme corresponding to the target text and the base frequency of each frame, using the pre-trained speech synthesis model to synthesize speech corresponding to the target text;

wherein the time length predicting model, the base frequency predicting model and the speech synthesis model are all obtained by training based on the speech library resulting from speech splicing and synthesis;

wherein the training of the time length predicting model, the base frequency predicting model and the speech synthesis model, according to the text and corresponding speech in the speech library comprises:

extracting several training texts and corresponding training speeches from the text and corresponding speech in the speech library;

respectively extracting the time length of the state corresponding to each phoneme in each training speech and the base frequency corresponding to each frame, from the several training speeches;

training the time length predicting model according to respective training texts and the time length of the state corresponding to each phoneme in corresponding training speeches;

training the base frequency predicting model according to respective training texts and the base frequency corresponding to each frame in corresponding training speeches; and training the speech synthesis model according to respective training texts, corresponding respective training speeches, the time length of the state corresponding to each phoneme in corresponding respective training speeches and the base frequency corresponding to each frame.

2. The method according to claim 1, wherein before predicting a time length of a state of each phoneme corresponding to a target text and a base frequency of each frame, according to pre-trained time length predicting model and base frequency predicting model, the method further comprises:

upon using the speech library to perform speech splicing and synthesis, receiving the problematic speech fed back by a user and the target text corresponding to the problematic speech.

3. The method according to claim 1, wherein after the step of, according to the time length of the state of each phoneme corresponding to the target text and the base frequency of each frame, using a pre-trained speech synthesis model to synthesize speech corresponding to the target text, the method further comprises:

adding the target text and the corresponding synthesized speech into the speech library.

4. The method according to claim 1, wherein the speech synthesis model employs a WaveNet model.

5. A computer device, wherein the device comprises:

one or more processors, a memory for storing one or more programs, the one or more programs, when executed by said one or more processors, enable said one or more processors to implement a speech synthesis method, wherein the method comprises:

training a time length predicting model, a base frequency predicting model and a speech synthesis model, according to a text and corresponding speech in the speech library;

when problematic speech appears in speech splicing and synthesis, predicting a time length of a state of each phoneme corresponding to a target text corresponding to the problematic speech and a base frequency of each frame, according to the pre-trained time length predicting model and the base frequency predicting model;

according to the time length of the state of each phoneme corresponding to the target text and the base frequency of each frame, using the pre-trained speech synthesis model to synthesize speech corresponding to the target text;

wherein the time length predicting model, the base frequency predicting model and the speech synthesis model are all obtained by training based on the speech library resulting from speech splicing and synthesis;

wherein the training of the time length predicting model, the base frequency predicting model and the speech synthesis model, according to the text and corresponding speech in the speech library comprises:

extracting several training texts and corresponding training speeches from the text and corresponding speech in the speech library;

respectively extracting the time length of the state corresponding to each phoneme in each training speech and the base frequency corresponding to each frame, from the several training speeches;

training the time length predicting model according to respective training texts and the time length of the state corresponding to each phoneme in corresponding training speeches;

training the base frequency predicting model according to respective training texts and the base frequency corresponding to each frame in corresponding training speeches; and training the speech synthesis model according to respective training texts, corresponding respective training speeches, the time length of the state corresponding to each phoneme in corresponding respective training speeches and the base frequency corresponding to each frame.

6. A non-transitory computer readable medium on which a computer program is stored, wherein the program, when executed by a processor, implements a speech synthesis method, wherein the method comprises:

training a time length predicting model, a base frequency predicting model and a speech synthesis model, according to a text and corresponding speech in the speech library;

when problematic speech appears in speech splicing and synthesis, predicting a time length of a state of each phoneme corresponding to a target text corresponding to the problematic speech and a base frequency of each frame, according to the pre-trained time length predicting model and the base frequency predicting model;

according to the time length of the state of each phoneme corresponding to the target text and the base frequency of each frame, using the pre-trained speech synthesis model to synthesize speech corresponding to the target text;

wherein the time length predicting model, the base frequency predicting model and the speech synthesis model are all obtained by training based on the speech library resulting from speech splicing and synthesis;

wherein the training of the time length predicting model, the base frequency predicting model and the speech synthesis model, according to the text and corresponding speech in the speech library comprises:

extracting several training texts and corresponding training speeches from the text and corresponding speech in the speech library;

respectively extracting the time length of the state corresponding to each phoneme in each training speech and the base frequency corresponding to each frame, from the several training speeches;

training the time length predicting model according to respective training texts and the time length of the state corresponding to each phoneme in corresponding training speeches;

training the base frequency predicting model according to respective training texts and the base frequency corresponding to each frame in corresponding training speeches; and training the speech synthesis model according to respective training texts, corresponding respective training speeches, the time length of the state corresponding to each phoneme in corresponding respective training speeches and the base frequency corresponding to each frame.

* * * * *